US005938250A

United States Patent [19]

Onken

[11] Patent Number: 5,938,250

[45] **Date of Patent: *Aug. 17, 1999**

[54] LOCK FOR A CONTAINER LID

[75] Inventor: Donald R. Onken, Easton, Ill.

[73] Assignee: Onken Enterprises, Easton, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,551

[22] Filed: Apr. 30, 1997

[51] Int. Cl.[6] ..... E05L 1/04

[52] U.S. Cl. ..... 292/145; 292/281; 220/318

[58] Field of Search ..... 292/145, 281, 292/282, 283, 284, 287, 148, DIG. 44; 70/2, 158, 162, 170, 173; 220/322, 324, 756, 775, 770, 318

[56] References Cited

U.S. PATENT DOCUMENTS

| | | | |
|---|---|---|---|
| 1,031,483 | 7/1912 | Staples | 292/281 |
| 2,349,926 | 5/1944 | Appel | 292/145 |
| 2,536,352 | 1/1951 | Butcher | 292/148 |
| 3,787,082 | 1/1974 | Foote | 292/281 |
| 3,999,790 | 12/1976 | Rogen | 292/282 |
| 5,343,977 | 9/1994 | Bryan | 292/281 |

*Primary Examiner*—Steven Meyers
*Assistant Examiner*—Gary Estremsky
*Attorney, Agent, or Firm*—Edwin E. Greigg; Ronald E. Greigg

[57] ABSTRACT

A lock for a container lid which comprises a retractable U-shaped handle secured for movement within apertures in a side of a container and a U-shaped handle which is fixed to the container lid. In closing of the container lid, the lid is closed with the fixed U-shaped handle straddling the retractable U-shaped handle in a retracted position. When the lid is in place, the retractable U-shaped handle is pulled outwardly and the retractable U-shaped handle is secured by some lock means to the U-shaped fixed handle. Thus, the container lid cannot be opened until the lock is removed.

1 Claim, 1 Drawing Sheet

LOCK FOR A CONTAINER LID

BRIEF SUMMARY OF THE INVENTION

This invention relates to a retractable handle for retaining a lid of a container in a closed position which prevents opening the lid due to wind or other weather conditions as well as by animals or persons and which permits stacking of several containers.

PRIOR ART RELATED TO THE INVENTION

Heretofore various means have been used by which a lid or cover for a container has been secured in place to prevent opening the lid by the wind and which permits easy stacking of the containers. Some arrangements for locking a lid to a container have been set forth in the following patents: U.S. Pat. Nos. 1,040,014; 3,572,870; 3,988,802; 4,320,851; 4,666,054; 5,050,761; UK 2,242,674.

OBJECTS OF THE INVENTION

It is therefore an object to interfitting handles which can be brought together to secure a lid to a container.

Another object is to provide two-pieces which fit together to secure a container against unwanted opening. One piece is on the container and one piece is on the lid.

Still another object is to provide lid retaining means of a container in which a securing part in the container is retractable so that the lid can close over the lid retaining means on the container.

Yet another object is to provide a lid retaining means which is retractable so that one container can be easily stacked into another container.

The invention will be better understood and further objects and advantages thereof will become more apparent from the ensuing detailed description of preferred embodiments taken in conjunction with the drawings.

DETAILED DESCRIPTION OF THE DRAWINGS

Figure 1:
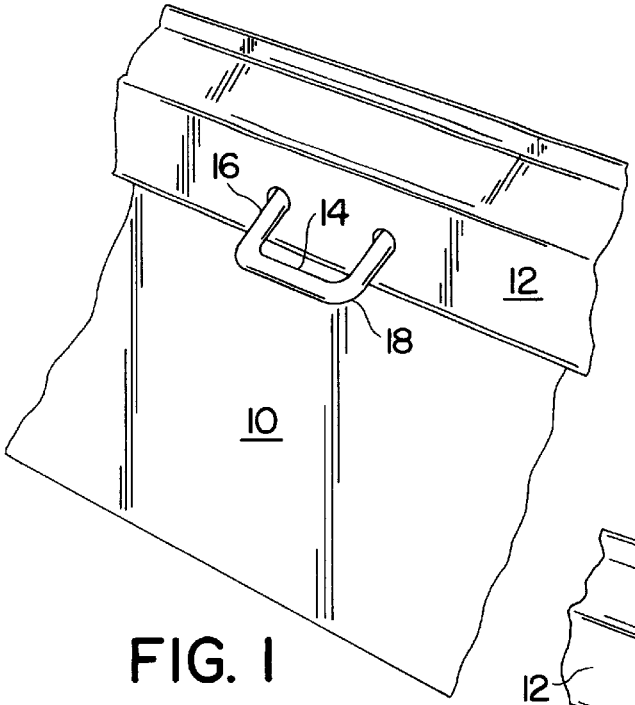
FIG. 1 illustrates a U-shaped locking handle which is secured to a lid locking side of a container.

Now referring to the drawings wherein like reference characters refer to like parts throughout the drawings; there is shown a container 10 having a protruding lip 12 to which a U-shaped locking handle 14 is secured. The lip 12 has spaced apertures therein through which legs 16 and 18 protrude loosely. The legs 16 and 18 each have a means for securing the locking handle within the apertures, such as threaded ends onto which threaded nuts 20 are threaded. The threaded nuts will not pass through the apertures; therefore, the U-shaped handle will be retained with the secured ends in the front of the container.

Figure 2:
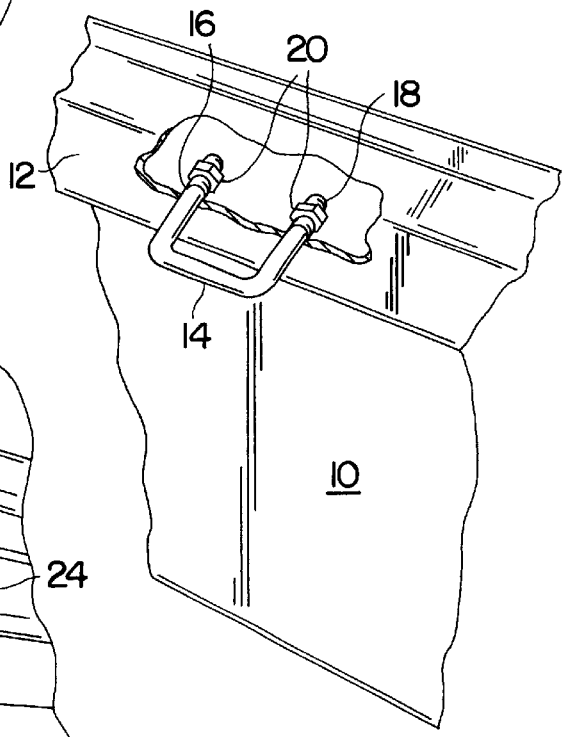
FIG. 2 illustrates a cut-away view to show the handle shown in FIG. 1 in a retracted position relative to a side of the container.

FIG. 2 illustrates a cut away view which shows the legs 16 and 18 retracted into the lip which also shows the nuts 20.

Figure 3:
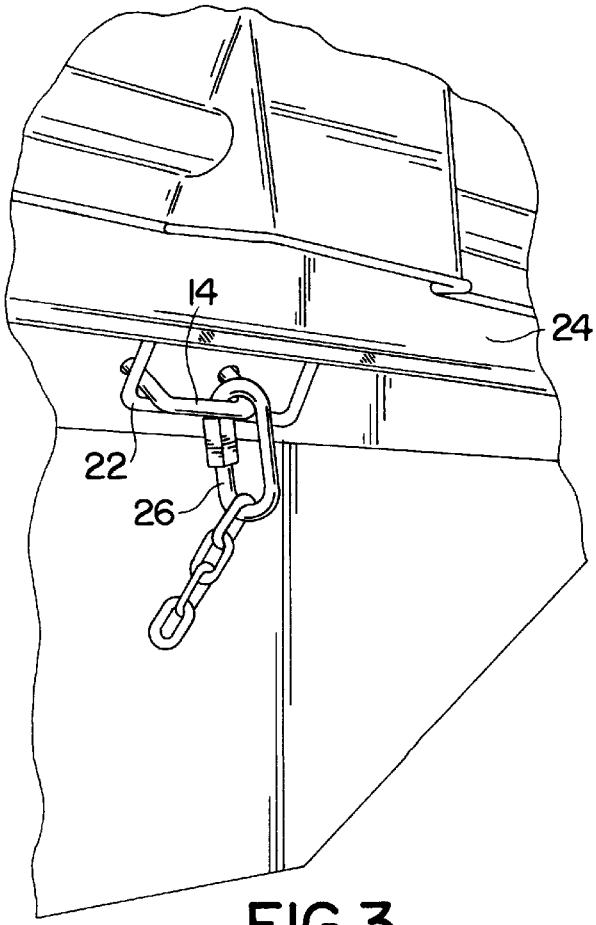
FIG. 3 illustrates the cover in a closed locked position relative to the retractable handle.

FIG. 3 illustrates the U-shaped handle 14 secured together with a U-shaped handle 22 secured onto a closure lid 24. As shown, the closure lid is lowered onto the upper end of the container such that the lid rests onto the upper surface of the lip 14. The U-shaped handle on the lid is fixed in place on the lid and is of sufficient width that the fixed U-shaped handle fits to an outside of each of the legs 16, 18 of the U-shaped handle 14. As shown, the U-shaped handle 14 is withdrawn outwardly from the container but is retained on the container by the nuts on the inner ends. A lock means 26 is then secured to the U-shaped handle 14 to retain the U-shaped handle within the fixed handle 22. The lock means could encircle the U-shaped handle end 14 and the fixed handle 22 to ensure that the two U-shaped handle 14 and 22 are retained together by the lock means.

When stacking the containers the retractable U-shaped handle is pushed inwardly so that the outer portion is juxtaposed the lip of the container. Then one container can fit into the other without any problems. If the U-shaped handle 14 was secured in a fixed position to the front of the container, then the U-shaped handle 14 would project outwardly too far for good stacking and further the U-shaped handle 14 would be extended too far to fit into the fixed U-shaped handle 22.

It is therefore seen that the retractable U-shaped handle 14 and the fixed U-shaped handle can be assembled together and locked so that the container lid will be maintained in a locked position against any undesired opening of the container lid.

The foregoing relates to preferred exemplary embodiments of the invention, it being understood that other variants and embodiments thereof are possible within the spirit and scope of the invention, the latter being defined by the appended claims.

What is claimed is:

1. A container including a lock for a container lid of the container which comprises, a retractable loose fitting first U-shaped handle attached to a side of the container and which is retractable into said container, said first U-shaped handle includes spaced parallel legs which pass through spaced apertures in the side of the container, said spaced apertures having a larger diameter than said legs of said first U-shaped handle, said spaced apertures in a side of the container are in a horizontal plane relative to the container lid of said container, said parallel legs of said first U-shaped handle which pass through said spaced apertures have threaded ends on which securing nuts are threaded in order to prevent said threaded ends from passing back through said spaced apertures which secures said first U-shaped handle to said side of the container, a fixed second U-shaped handle is attached to the container lid of said container in a corresponding area of said first U-shaped handle, said second U-shaped handle has spaced parallel legs perpendicular to the container lid relative to said first U-shaped handle, said spaced parallel legs of said fixed second U-shaped handle has a greater spacing than said legs of said first U-shaped handle and extend vertically from said container lid to an area of said first U-shaped handle when said container lid is in a closed position, said first U-shaped handle is extendable from a retracted position between said spaced legs of said second U-shaped handle so that an outer end of said first U-shaped handle is secured relative to said second U-shaped handle to prevent said container lid from opening unnecessarily.

* * * * *